US005256941A

United States Patent [19]

Gijrath et al.

[11] Patent Number: 5,256,941

[45] Date of Patent: Oct. 26, 1993

[54] COLOR DISPLAY TUBE HAVING A SUSPENSION MEANS FOR A COLOR SELECTION ELECTRODE

[75] Inventors: Johannes H. N. Gijrath; Theodoor C. A. Hens, both of Eindhoven, Netherlands

[73] Assignee: U.S. Philips Corporation, New York, N.Y.

[21] Appl. No.: 706,825

[22] Filed: May 29, 1991

[30] Foreign Application Priority Data

Jun. 29, 1990 [NL] Netherlands ..... 9001490

[51] Int. Cl.[5] ..... H01J 29/07

[52] U.S. Cl. ..... 313/404; 313/406; 313/407

[58] Field of Search ..... 313/404, 406, 407

[56] References Cited

U.S. PATENT DOCUMENTS 4,644,222 2/1987 Brunn ..... 313/406

4,987,337 1/1991 Bongenaar et al. ..... 313/406

OTHER PUBLICATIONS

"A New Shadow-Mask Suspension System . . . " by K. Tokita et al, Proceedings of the SID, vol. 29/1, 1988, pp. 13-17.

*Primary Examiner*—Palmer C. Demeo

*Attorney, Agent, or Firm*—Paul R. Miller

[57] ABSTRACT

A color display tube is set forth comprising a color selection electrode which is suspended from supporting elements in the corners of the display window of the color display tube. The suspension elements used to suspend the color selection electrode from the supporting elements comprise a resilient element which encloses an angle $\alpha$ with the normal to the center of the display window. The angle $\alpha$ (in degrees) is defined by:

$$\alpha = 90 - x/2 - \delta$$

where x is the maximum deflection angle of the electrons in the color display tube, and $$6.5 < \delta < 1.5.$$

In the case of a 110° tube, $28.5° < \alpha < 33.5°$. By virtue thereof, the effect of overall doming is substantially equal to the effect of ambient doming, as a result of which the average picture quality is improved.

13 Claims, 3 Drawing Sheets

COLOR DISPLAY TUBE HAVING A SUSPENSION MEANS FOR A COLOR SELECTION ELECTRODE

The invention relates to a color display tube comprising an evacuated envelope having a display window which is provided with a phosphor pattern on the inside, a means of generating a number of electron beams, which is arranged in the evacuated envelope, a color selection electrode having a large number of apertures for passing the electron beams, which color selection electrode is arranged in the evacuated envelope in front of the display window, supporting elements which are fixed in the corners of the display window, suspension means for suspending the color selection electrode from the supporting elements, which suspension means are connected to the color selection electrode and comprise resilient elements of sheet material for compensating the effects of thermal expansion of the color selection electrode by moving the corners of the color selection electrode along paths which enclose an angle $\alpha$ with the color selection electrode.

Color display tubes are used in, inter alia, color display devices.

BACKGROUND OF THE INVENTION

A color display tube of the type mentioned in the opening paragraph is known from British Patent Specification 1,189,403.

As regards color display tubes, the aim is to improve the display quality.

SUMMARY OF THE INVENTION

It is an object of the invention to provide a color display tube of the type mentioned in the opening paragraph, which tube has an improved display quality.

For this purpose, the color display tube according to the invention is characterized in that the angle $\alpha$ (in degrees) meets the requirement:

$$\alpha = 90° - x/2 - \delta,$$

where x is the maximum deflection angle of the electron beams and $$6.5° < \delta < 1.5°.$$

In the case of a 110° color display tube, x/2 is 55°. Consequently, in accordance with the invention, $\alpha$ ranges between 28.5 and 33.5 degrees. Preferably, $\delta$ ranges between 3 and 5 degrees. For a 110° color display tube this corresponds to $30° < \alpha < 32°$.

In color display tubes a number of display errors occur during operation. A display error is the so-called "overall doming": the color selection electrode warms-up as a result of being irradiated by the electron beams. As a result thereof, the color selection electrode expands and the position of the apertures in the color selection electrode changes relative to the phosphor pattern. The spot of an electron beam, i.e. the position where an electron beam is incident on the phosphor pattern after having passed through an aperture in the color selection electrode, is displaced thereby.

A further display error is the so-called "ambient doming". A change of the temperature of the color display tube as a whole causes the spot of an electron beam to shift.

The invention is based on the insight that the average display quality can be improved when both of the above display errors are substantially equal to each other. Experiments have shown that this occurs when the angle $\alpha$ is in the indicated range. In the known color display tube, the resilient element is a flat resilient element and extends perpendicularly to the electron beams which are deflected to the corners, so that $\delta = 0°$.

BRIEF DESCRIPTION OF THE DRAWINGS

The invention will be explained in greater detail by means of a few embodiments of a color display tube according to the invention and with reference to the accompanying drawing, in which.

The Figures are diagrammatic representations and are not drawn to scale, corresponding parts generally bearing the same reference numerals.

DESCRIPTION OF THE INVENTION

Figure 1:
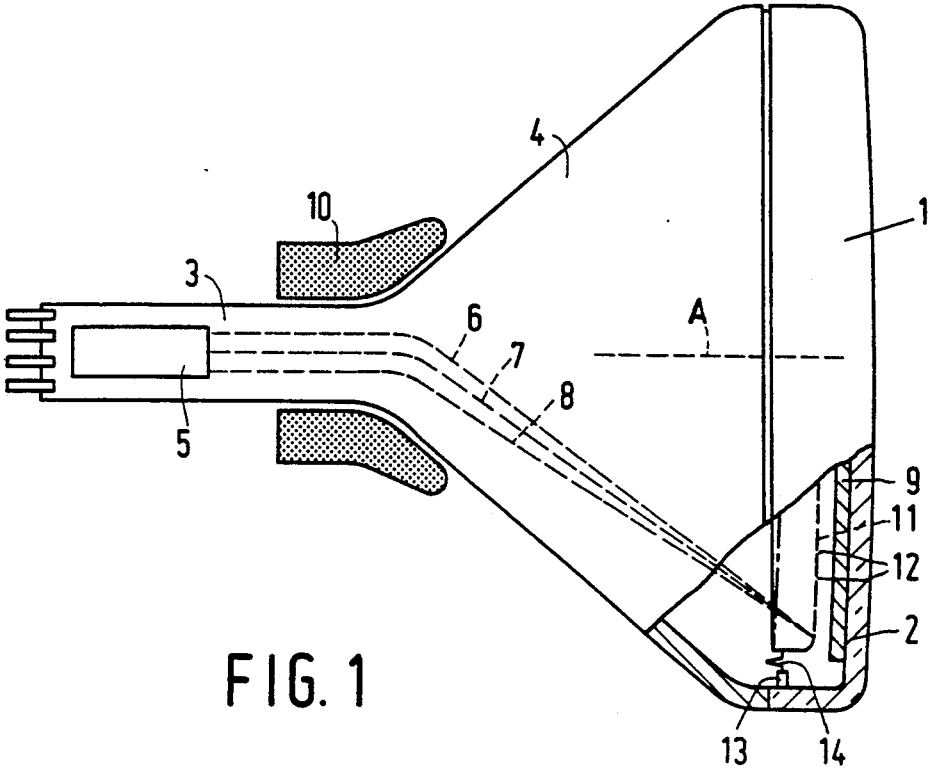
FIG. 1 is a sectional view of a color display tube according to the invention.

FIG. 1 shows a horizontal sectional view of a color display tube which comprises an evacuated envelope 1 having a substantially rectangular display window 2, an enveloping part 4 and a neck 3. In the neck there is provided an electrode system 5 having three electron guns for generating three electron beams 6, 7 and 8. These electron beams are generated in one plane (in this case the plane of the drawing) and are directed to a display screen 9 which is provided on the inside of the display window 2. The display screen comprises a phosphor pattern consisting of a large number of phosphor elements luminescing in red, green and blue. The phosphor elements may be in the form of, for example, dots or strips. By way of example, the invention is described by means of strip-shaped elements whose longitudinal direction extends transversely to the plane through the electron beams (in this case the plane of the drawing). On their way to the display screen 9, the electron beams 6, 7 and 8 are deflected across the display screen 9 by means of a deflection unit 10 and pass through a color selection electrode 11, which is arranged in front of the display window 2, and which comprises a thin metal plate with apertures 12. In the present example, the apertures are elongated, the longitudinal direction extending parallel to the phosphor elements of the display screen 9. The three electron beams 6, 7 and 8 pass through the apertures 12 at a small angle with each other and, consequently each impinge on phosphor elements of only one color. By means of suspension means 14, the color selection electrode 11 is suspended from supporting elements 13 which are secured to the display window 2. Each suspension means 14 comprises a resilient element of sheet material which is secured to the color selection electrode 11. In the undeflected state, the electron beam 7 coincides with the tube axis A. The tube axis approximately coincides with the axis of the color selection electrode.

Figure 2:
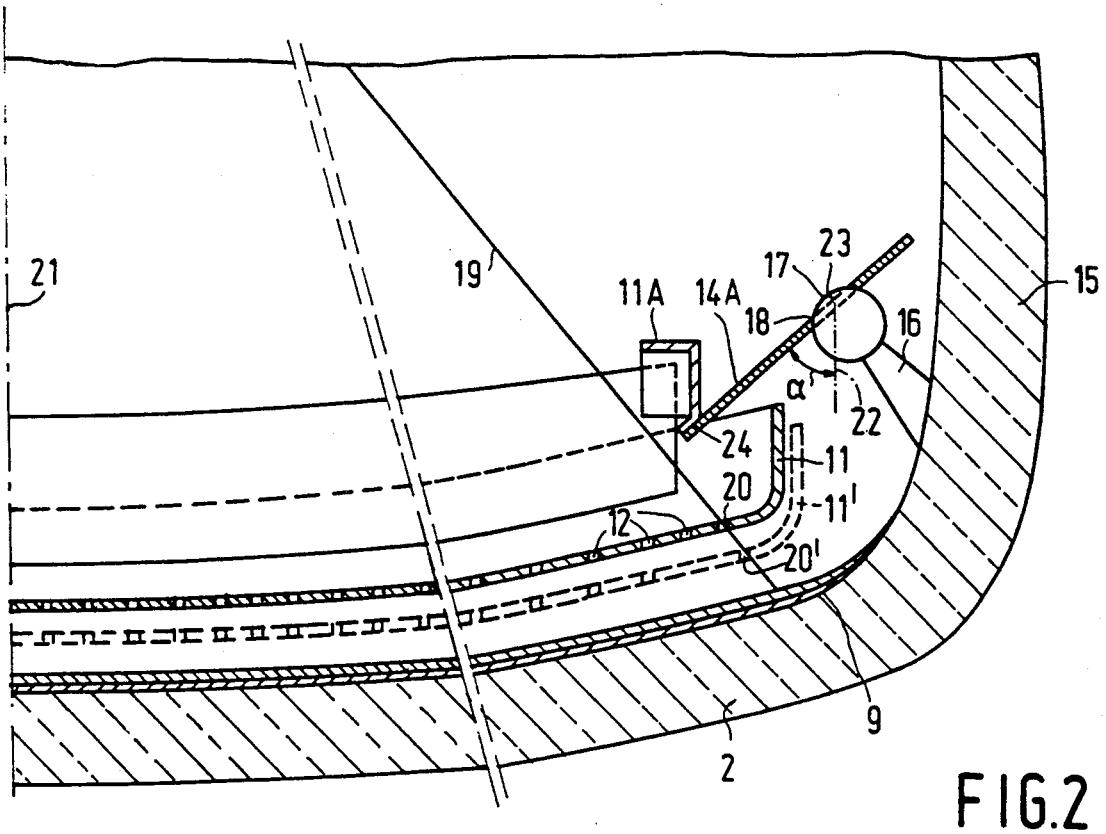
FIG. 2 is a detailed sectional view of an embodiment of a color display tube according to the invention.
Figure 2A:
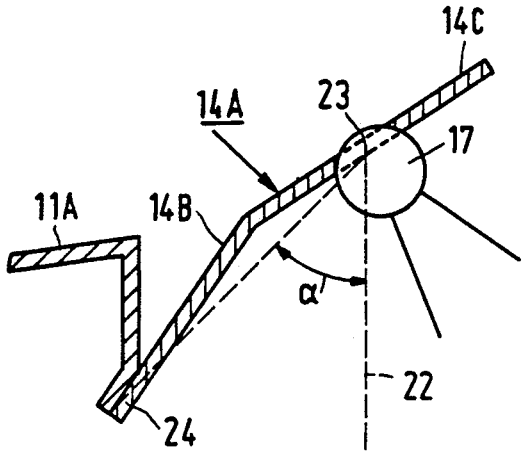
FIG. 2*a* is a detailed sectional view of an embodiment of a color display tube according to the invention, FIG. 2*b* diagrammatically shows the movement of the edge of the color selection electrode, FIGS. 3*a* and 3*b* graphically show the effect of overall doming and ambient doming as a function of the angle $\alpha$ for two types of suspension means.

FIG. 2 is a sectional view of a detail of a color display tube according to the invention. The display window 2 has a raised edge 15 in the corners from which supporting means, for example in the form of pins 16 having a free end portion 17, are provided. The supporting means are provided, for example, by means of fusion or thermocompression. The free end portion 17 of the pin 16, which end portion is for example spherically shaped, projects partly through aperture 18 in the resilient element which in the present, simple embodiment is a flat resilient element 14A of sheet material. Electron beam 19 passes through aperture 20 in the color selection electrode 11 and is incident on a phosphor element of the display screen 9. The resilient element 14A forms an angle $\alpha$ with the axis of the color selection electrode 11, i.e. with the normal 21 to the center of the color selection electrode 11. In FIG. 2, a line 22 which extends parallel to the axis 21 of the color selection electrode 11 is drawn to make the angle $\alpha$ visible. The angle $\alpha$, which is formed by the resilient element 14A and the normal to the center of the color selection electrode, is defined by a plane between the points 23, i.e. the point of fixation of resilient element 14A on pin 16, and the points 24, i.e. the points of fixation of resilient element 14A on the color selection electrode, in this case at the edge 11A of the color selection electrode. FIG. 2A shows a detail of an embodiment of the color display tube according to the invention. In the present exemplary embodiment, the resilient element 14A comprises portions 14B and 14C which form a small angle with each other. Points 23 and 24 are indicated. As shown in FIG. 2A, the angle $\alpha$ is defined by a plane through the points 23 and 24 and the axis 22.

Figure 2B:
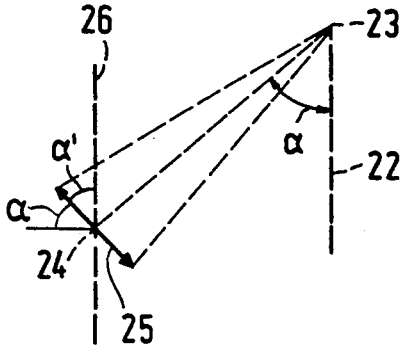

FIG. 2B diagrammatically shows the movement of the edge of the color selection electrode in the corners as a result of thermal effects. The resilient element 14A is constructed such that if point 23 does not move relative to the axis of the color selection electrode, the edge 11A, in this case point 24, moves in accordance with a path 25 when the color selection electrode is subject to expansion, which path forms an angle $\alpha'$ (complementary to the angle $\alpha$ between the points 23 and 24) with line 26. Line 26 extends parallel to the axis of the color selection electrode.

The spot of electron beam 19 on the phosphor pattern 9 depends on the position of the apertures 20 (FIG. 2) relative to the phosphor pattern 9. The position of the apertures 20 relative to the phosphor pattern 9 can change as a result of variations in temperature. This causes the target of electron beam 19 on the phosphor pattern 9 to be displaced. In this connection, various thermal effects can be distinguished.

The color selection electrode 11 warms-up as a result of the fact that it is irradiated by the electron beams. Consequently, it expands. This causes the position of aperture 20 to change. Consequently, the spot of electron beam 19 is displaced. This displacement would be very large if the color selection electrode were rigidly arranged relative to the display window. The resilient element 14A ensures, however, that when the color selection electrode expands it is moved to position 11', as indicated in FIG. 2 by dotted lines. In this manner, the displacement of the spot on the phosphor pattern is partly compensated. The remaining displacement of the spot caused by the warming-up of the color selection electrode is termed "overall doming".

Another effect is that the tube as a whole is subject to changes in temperature, which are caused partly by changes in the ambient temperature and partly by the development of heat in the color display tube or in the vicinity of the color display tube, for example by deflection coils. The displacement of the spot caused by the change in temperature of the color display tube as a whole is termed "ambient doming".

The spot displacements which are caused by these effects appear to depend on the angle $\alpha$ which is formed between the resilient element and the normal. On average, an optimum display is attained when the spot displacement caused by one of the two effects is approximately equal to the spot displacement caused by the other effect.

Figure 3A:
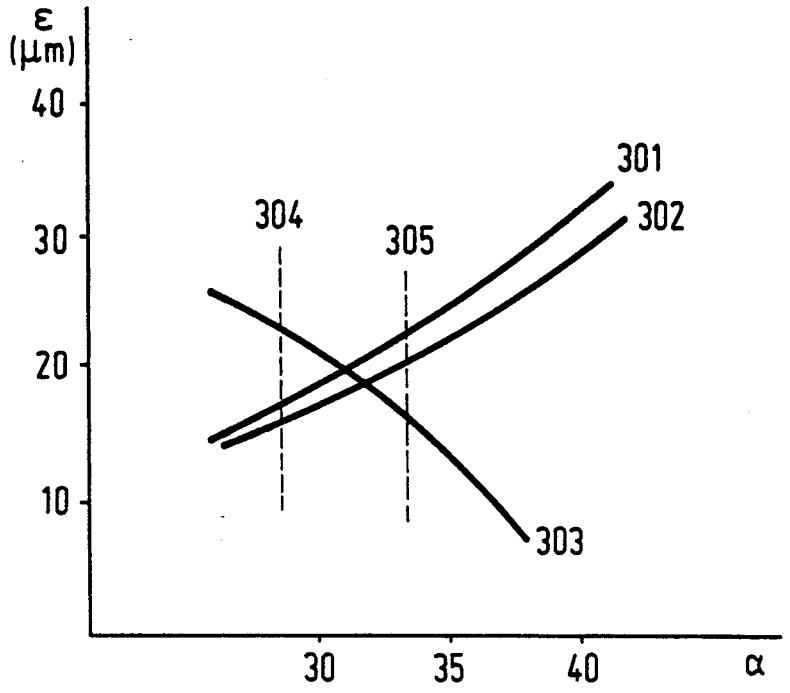
Figure 3B:
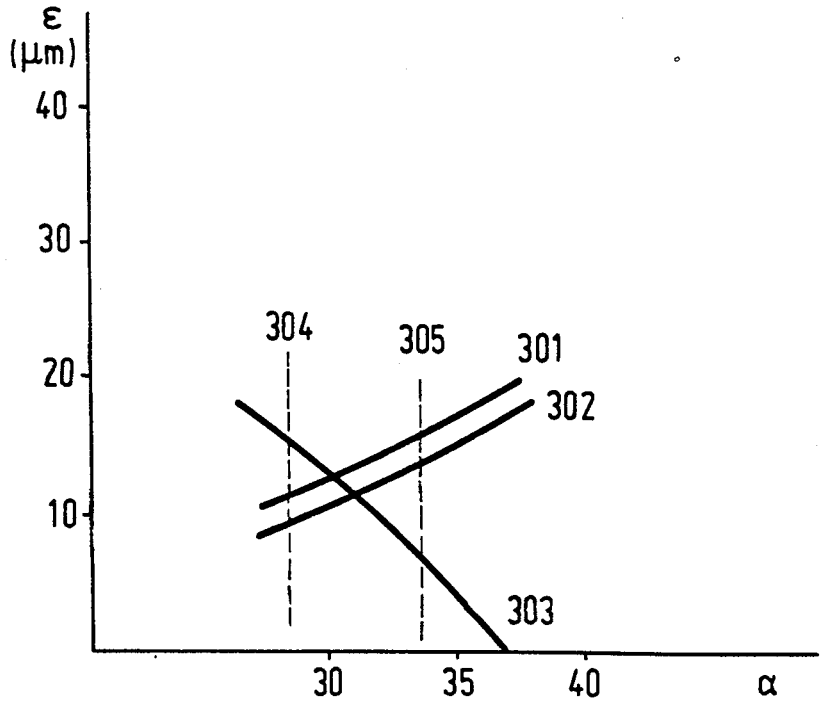

FIGS. 3A and 3B graphically show the displacement of the spot on the phosphor pattern for different effects, when using a 110° color display tube having a color selection electrode of a material with a low coefficient of expansion (maximally $10\times10^{-6}$° C.$^{-1}$), such as a Fe-Ni compound which is known under the trade name Invar. FIG. 3A shows on the vertical axis the displacement $\epsilon$ of the spot in $\mu$m and on the horizontal axis the angle $\alpha$ in degrees. FIG. 3A shows measured values of overall and ambient doming for a suspension means which consists of a material having a relatively high coefficient of expansion, such as iron. Line 301 shows the displacement as a result of overall doming at the end of the long axis of the display window, the intensity of the image corresponding to a customary image intensity. Line 302 shows the overall doming in the corners of the display window. Overall doming increases according as the angle $\alpha$ is larger. Line 303 shows the displacement of a spot as a result of ambient doming, measured at the same location as for line 301. Ambient doming decreases according as the angle $\alpha$ is larger. The range indicated by dotted lines 304 and 305 ($28.5° < \alpha < 33.5°$) corresponds to the range in which the effect of overall doming is approximately equal to the effect of ambient doming. Preferably, $\alpha$ ranges between 30 and 32 degrees.

FIG. 3B gives measured values of overall and ambient doming for a suspension means composed of a material having a relatively low coefficient of expansion, such as a Fe-Ni compound which is known under the trade name Invar. The range indicated by dotted lines 304 and 305 ($28.5° < \alpha < 33.5°$) corresponds to the range in which the effect of overall doming is approximately equal to the effect of ambient doming. Preferably, $\alpha$ ranges from 30 to 32 degrees.

It will be obvious, that within the scope of the invention many variations are possible to those skilled in the art.

Figure 4:
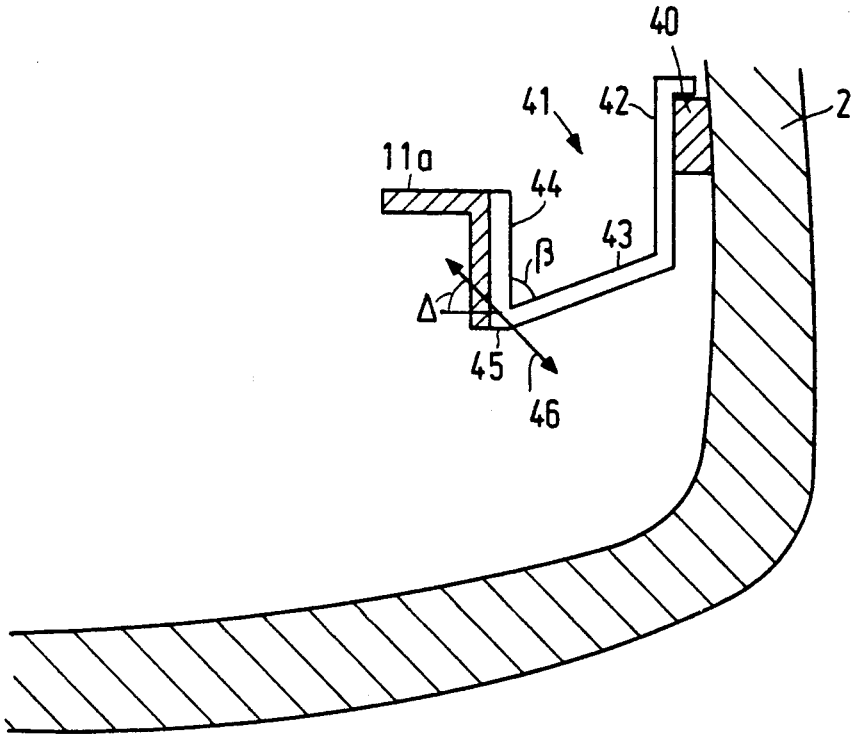
FIG. 4 is a sectional view of a detail of a color display tube.

FIG. 4 shows, for example, a more complicated suspension means 41 which is supported by supporting means 40 and connected to edge 11*a* of the color selection electrode. Suspension means 41 comprises portions 42, 43 and 44. By providing a marking on edge 11*a*, for example at point 45, it is possible to determine the path 46 along which the corners of the color selection electrode move when the color selection electrode expands. Further variations are possible by determining this path, and more in particular the angle $\Delta$ which the path 46 encloses with the axis of the color selection electrode, as a function of a parameter of the suspension means, for example as a function of the angle $\beta$ between portions 43 and 44 or as a function of the length of portion 42 at an otherwise unmodified construction of the suspension means, plotting the values found for Δ versus the parameter in a graph, and determining the interval of the parameter at which the angle Δ falls within the defined range by means of interpolation or extrapolation. The angle enclosed by a path 46 and the color selection electrode is to be understood to mean herein the angle between the path and the plane of the colour selection electrode with the axis of the color selection electrode being the normal of the plane.

We claim:

1. A color display tube comprising (a) an evacuated envelope having a display window with a phosphor pattern on an interior surface, said display window having corners, (b) means for generating a plurality of electron beams onto said display window, said means being disposed within said evacuated envelope, (c) color selection electrode means having a large number of apertures for passing said electron beams, said color selection electrode means being disposed within said evacuated envelope in front of said display window, said color selection electrode means having corners.

(d) supporting elements fixed at said corners of said display window, (e) suspension means being connected to said color selection electrode means for suspending said color selection electrode means from said supporting elements, said suspension means including resilient sheet material means for enabling movement of said corners of said color selection electrode means along paths making an angle $\alpha$ with a normal to said color selection electrode means, where the angle $\alpha$ equals 90° minus one-half of a maximum deflection angle of said electron beams minus an angle in the range between 1.5° and 6.5°.

2. A color display tube according to claim 1, wherein said maximum deflection angle equals 110°, and wherein said angle $\alpha$ ranges between 28.5° and 33.5°.

3. A color display tube according to claim 2, wherein said angle $\alpha$ ranges between 30° and 32°.

4. A color display tube according to claim 2, wherein said resilient sheet material means are elongated flat resilient elements extending between said supporting elements and said corners of said color selection electrode means at approximately said angle $\alpha$.

5. A color display tube according to claim 2, wherein said resilient sheet material means are each two elongated flat resilient portions disposed at a small angle with respect to each other to provide a resilient element extending between said supporting elements and said corners of said color selection electrode means, said resilient element being disposed substantially at an angle approximately equal to said angle $\alpha$.

6. A color display tube according to claim 2, wherein said resilient sheet material means are each a plurality of elongated flat resilient portions disposed at different angles with respect to each other to provide a complex resilient member extending between said supporting elements and said corners of said color selection electrode means.

7. A color display tube according to claim 2, wherein said color selection electrode means is a member of substantially a material having a coefficient of thermal expansion with a maximum absolute value of $10\times10^{-6}$ per degree Centigrade.

8. A color display tube according to claim 7, wherein said suspension means is a member of substantially a material having a coefficient of thermal expansion with a maximum absolute value of $10\times10^{-6}$ per degree Centrigrade.

9. A color display tube according to claim 1, wherein said resilient sheet material means are elongated flat resilient elements extending between said supporting elements and said corners of said color selection electrode means at approximately said angle $\alpha$.

10. A color display tube according to claim 1, wherein said resilient sheet material means are each two elongated flat resilient portions disposed at a small angle with respect to each other to provide a resilient element extending between said supporting elements and said corners of said color selection electrode means, said resilient element being disposed substantially at an angle approximately equal to said angle $\alpha$.

11. A color display tube according to claim 1, wherein said resilient sheet material means are each a plurality of elongated flat resilient portions disposed at different angles with respect to each other to provide a complex resilient member extending between said supporting elements and said corners of said color selection electrode means.

12. A color display tube according to claim 1, wherein said color selection electrode means is a member of substantially a material having a coefficient of thermal expansion with a maximum absolute value of $10\times10^{-6}$ per degree Centigrade.

13. A color display tube according to claim 12, wherein said suspension means is a member of substantially a material having a coefficient of thermal expansion with a maximum absolute value of $10\times10^{-6}$ per degree Centigrade.

* * * * *